US005410113A

United States Patent [19]

Mielke

[11] Patent Number: 5,410,113

[45] Date of Patent: Apr. 25, 1995

[54] MOTION SENSING APPARATUS

[75] Inventor: James S. Mielke, Wauconda, Ill.

[73] Assignee: Motorola, Inc., Schaumburg, Ill.

[21] Appl. No.: 131,240

[22] Filed: Oct. 4, 1993

[51] Int. Cl.[6] ..... H01H 35/14

[52] U.S. Cl. ..... 200/61.45 R; 200/61.52; 200/DIG. 29

[58] Field of Search ..... 200/61.45 R–61.53, 200/61.45 M, DIG. 29

[56] References Cited

U.S. PATENT DOCUMENTS

| | | | |
|---|---|---|---|
| 3,564,496 | 2/1971 | Brooks et al. | 340/52 |
| 3,601,729 | 8/1971 | Hierta | 335/205 |
| 3,733,447 | 5/1973 | Schneider, Jr. | 200/61.52 |
| 3,742,478 | 6/1973 | Johnson | 200/61.52 X |
| 3,748,415 | 7/1973 | Suzuki | 200/61.45 M |
| 3,757,266 | 9/1973 | Newman et al. | 200/DIG. 29 X |
| 3,760,733 | 9/1973 | Marchiando | 200/61.45 R X |
| 4,168,410 | 9/1979 | Norris | 200/61.45 R X |
| 4,318,245 | 3/1982 | Stowell et al. | 200/61.52 X |
| 4,450,326 | 5/1984 | Ledger | 200/61.45 M |
| 4,884,067 | 11/1989 | Nordholm et al. | 340/686 |
| 5,006,676 | 4/1991 | Bogut et al. | 200/61.52 |
| 5,149,926 | 11/1992 | Ono | 200/61.45 M |

*Primary Examiner*—J. R. Scott

*Attorney, Agent, or Firm*—James A. Coffing; Daniel C. Crilly

[57] ABSTRACT

A motion sensing apparatus comprises two substrates, contact means, and at least one electrically conductive element. A first substrate contains an electrically conductive layer disposed on one of its major surfaces. A second substrate contains a hole, including an interior surface that extends from one major surface to another, such that a cavity is formed by the planes of the major surfaces and the interior surface. The second substrate is positioned substantially parallel to the first substrate, such that the electrically conductive layer is positioned within an area defined by the hole. The contact means and the electrically conductive element are placed within the cavity, such that a motion sensing signal is produced when the electrically conductive element comes in contact with both the contact means and the electrically conductive layer.

9 Claims, 2 Drawing Sheets

MOTION SENSING APPARATUS

FIELD OF THE INVENTION

The present invention relates generally to motion detectors and, in particular, to a motion sensing apparatus that is capable of sensing motion in three dimensions.

BACKGROUND OF THE INVENTION

Motion detectors are generally utilized to sense the movement of objects to which they are attached. A common application of a motion detector is its use to detect motion of an automobile in an automobile alarm. The motion detector and its corresponding detection and control circuitry are colocated, typically in a metal or plastic housing. The housing is connected via screws, or other equivalent fasteners, to the automobile's body. When the alarm is activated, movement of the automobile, as detected by the motion detector, results in an audible alarm, flashing of the automobile's headlights and taillights, or remote actuation of the automobile owner's alarm pager depending on the functionality of the alarm's detection and control circuitry.

Motion detectors are fabricated using a variety of materials. Three of the most common motion detectors are crushed carbon sensors, micromachined sensors, and mercury-switched sensors. Crushed carbon sensors typically comprise a volume of encapsulated crushed carbon with an electrode attached to each of two opposing sides of the volume. The electrodes measure the resistance of the encapsulated crushed carbon. Thus, when the crushed carbon sensor is in motion, the crushed carbon moves and creates a resistance variation between the two electrodes. However, due to its material composition and sensor configuration, the crushed carbon sensor only detects motion in one dimension and has limited sensitivity. That is, the crushed carbon sensor is only sensitive to high acceleration and deceleration forces (greater than 1 G).

Micromachined sensors typically comprise a micromachined metallic object positioned within a recessed area of a silicon substrate. The recessed area includes four walls, each having an accelerometer electrode attached thereto. When the micromachined sensor is in motion, the metallic object moves within the recessed area and contacts the electrodes. Due to its mechanical and material construction, the micromachined sensor accurately senses low acceleration and deceleration forces (less than 0.1 G). However, the micromachined sensor only detects motion in two dimensions and cannot structurally withstand extremely high acceleration and deceleration forces (greater than 1000 G).

Mercury-switched sensors typically comprise a mercury-filled tube with electrodes at each truncated end and an electrical contact along the tube's body length. The electrical contact is isolated from the electrodes and typically connected to direct current (DC) ground. When the mercury-switched sensor is in motion, the mercury moves within the tube and provides contact between the electrical contact and either one of the two electrodes, effectively creating a DC ground at the contacted electrode. Although the mercury-switched sensor accurately detects low acceleration and deceleration forces, it only senses motion in one dimension, cannot endure extremely high acceleration and deceleration forces, is large in size (approximately 1.25 centimeters in length), and contains environmentally hazardous material (mercury).

Therefore, a need exists for a motion sensing apparatus that is small in size, that is environmentally preferable, that detects low acceleration and deceleration forces in three dimensions, and that can structurally endure extremely high acceleration and deceleration forces.

DESCRIPTION OF A PREFERRED EMBODIMENT

Generally, the present invention provides a motion sensing apparatus that includes two substrates, contact means, and at least one electrically conductive element. A first substrate contains an electrically conductive layer disposed on one of its major surfaces. A second substrate contains a hole, including an interior surface that extends from one major surface to another, such that a cavity is formed by the planes of the major surfaces and the interior surface. The second substrate is positioned substantially parallel to the first substrate, such that the electrically conductive layer is positioned within an area defined by the hole. The contact means and the electrically conductive element are placed within the cavity, such that a motion sensing signal is produced when the electrically conductive element comes in contact with both the contact means and the electrically conductive layer.

Figure 1:
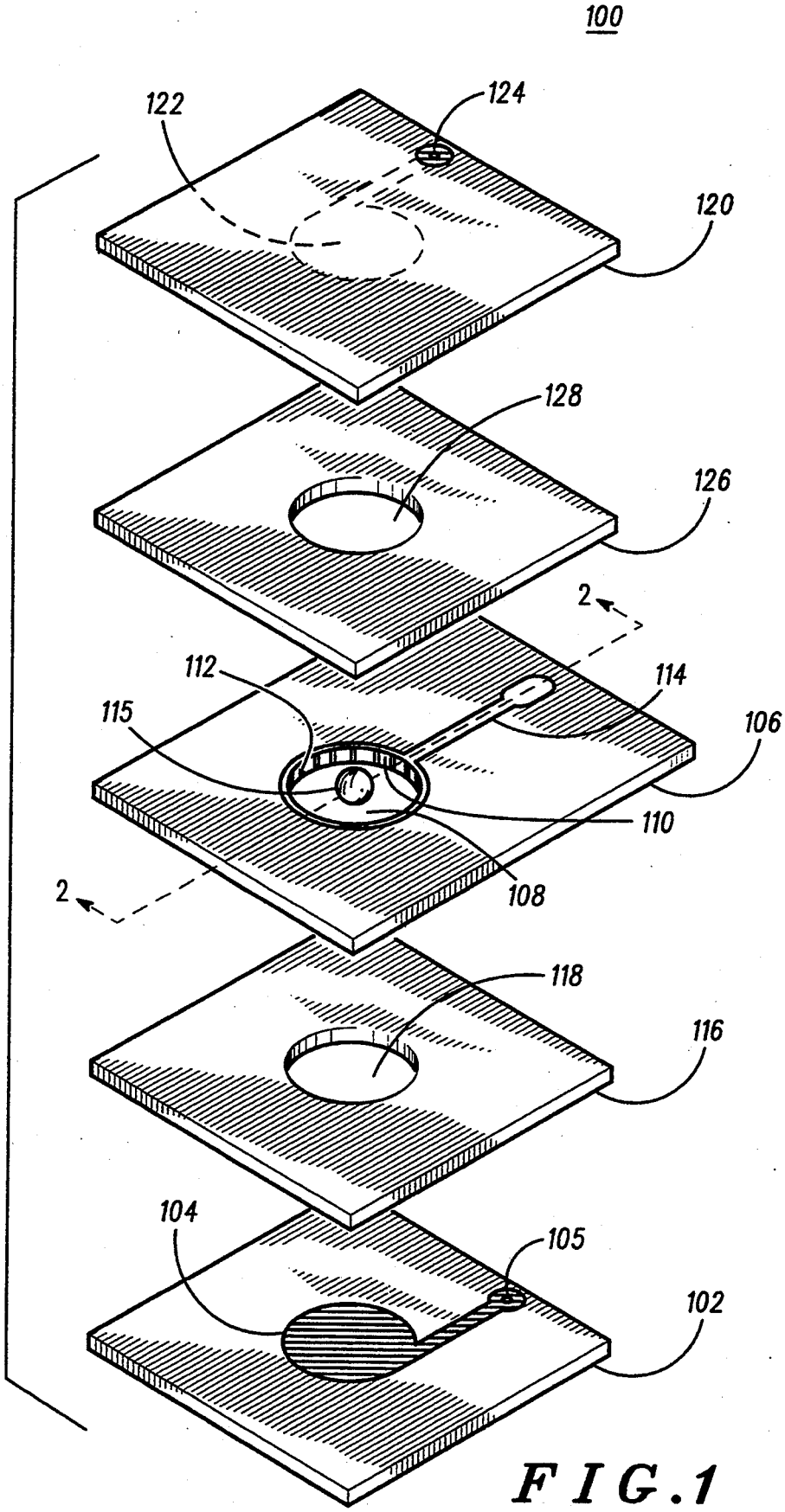
FIG. 1 illustrates an exploded frontal view of a motion sensing apparatus in accordance with the present invention.

The present invention can be more fully described with reference to FIGS. 1 and 2. FIG. 1 illustrates an exploded frontal view of a motion sensing apparatus 100 that includes a first substrate 102, a second substrate 106, a third substrate 120, first insulating means 116, second insulating means 126, and an electrically conductive element 115, in accordance with the present invention. An electrically conductive first layer 104 is disposed on a first major surface of the first substrate 102 and, similarly, an electrically conductive second layer 122 is disposed on a first major surface of the third substrate 120. A first hole 108 is disposed through the second substrate 106 such that an interior surface 110 of the first hole 108 extends from the second substrate's first major surface to its second major surface. In a preferred embodiment, a plurality of electrically conductive strips 112 are deposited on the first hole's interior surface 110 and are electrically coupled to a circuit 114 disposed on the second substrate's first major surface. The first and second insulating means 116, 126 are positioned between the first and second substrates 102, 106, and the second and third substrates 106, 120, respectively, to provide electrical isolation between the electrically conductive strips 112 and the electrically conductive first and second layers 104, 122. The electrically conductive element 115 is positioned within a cavity formed by the first hole 108 and its interior surface 110 to provide electrical contact between the electrically conductive strips 112 and either the electrically conductive first layer 104, or the electrically conductive second layer 122. Electrical contact between the electrically conductive strips 112 and either electrically conductive layer 104, or 122, via the electrically conductive element 115, produces a motion sensing signal, such as a resistance, a voltage, or a current. This sensing signal is presented to the circuit 114, with reference to either the first substrate's feedthrough contact trace 105 or the third substrate's feedthrough contact trace 124, depending on which electrically conductive layer 104, 122 is in contact with the electrically conductive strips 112.

The elements of the motion sensing apparatus 100 may include a variety of materials. All three substrates 102, 106, 120 and both insulating means 116, 126 preferably comprise alumina ceramic, but may be alternatively fabricated from any printed circuit board material. When fabricated in either manner, the first insulating means 116 includes a second hole 118 disposed therethrough. Similarly, the second insulating means 126 includes a third hole 128 disposed therethrough. Thus, when the second and third holes 118, 128 are positioned substantially within an area defined by the first hole 108, the electrically conductive element 115 freely moves within the cavity provided between the first and third substrates 102, 120. Further, since the primary purpose of both insulating means 116, 126 is to isolate the electrically conductive layers 104, 122 from the plurality of electrically conductive strips 112, both insulating means 116, 126 may alternatively comprise spatial separation devices, such as standoffs.

When the second substrate 106 is fabricated from alumina or any printed circuit board material, the electrically conductive strips 112 preferably comprise copper or silver layers deposited on the interior surface 110 of the first hole 108. However, it is recognized that the electrically conductive strips 112 function simply as contact means for providing a motion sensing signal to the circuit 114, thus they may be replaced with various other electrically conductive contacts, such as micro-sized springs or small wires.

The electrically conductive element 115 is preferably a single spherical ball, but multiple balls may be used. In addition, the electrically conductive element 115 may be various geometric shapes, other than that of a spherical ball, depending on the desired level of motion sensitivity.

In the preferred embodiment, the circuit 114 comprises a single electrically conductive trace that connects the electrically conductive strips 112 to external resistance sensing circuitry (not shown). Therefore, in this embodiment, the electrically conductive strips 112 are electrically coupled together along the major surface of the second substrate 106 that contains the circuit 114. However, in an alternate embodiment, the electrically conductive strips 112 may be independent of each other (i.e., not electrically coupled along the major surface). Thus, in order to accommodate the plurality of independent electrically conductive strips 112, the circuit 114 may be correspondingly divided into a plurality of circuits, each circuit 114 coupling an electrically conductive strip 112 to the resistance sensing circuitry. This latter situation may also be used with a microprocessor to provide a detailed electronic description of the movement of the motion sensing apparatus 100. Further, depending on the physical construction of the motion sensing apparatus 100, the circuit 114 may include discrete, or integrated, circuit elements to produce a particular motion sensing signal at the circuit's output.

Figure 2:
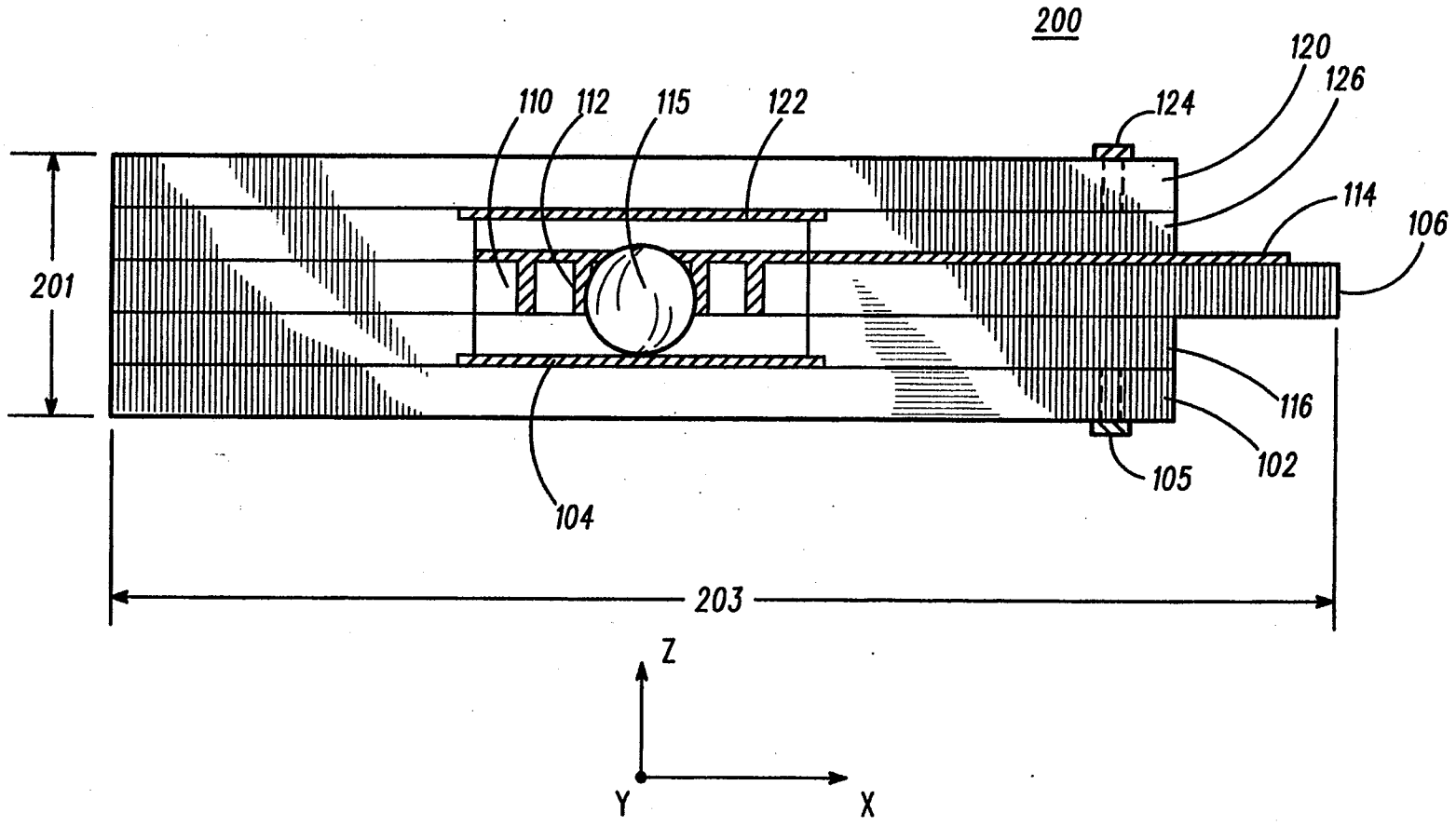
FIG. 2 illustrates a cross-sectional view of an assembled motion sensing apparatus in accordance with the present invention.

FIG. 2 illustrates a cross-sectional view of an assembled motion sensing apparatus 200 along the 2—2 line of FIG. 1, in accordance with the present invention. The assembled motion sensing apparatus 200 includes the first substrate 102, the second substrate 106, the third substrate 120, the first insulating means 116, the second insulating means 126, and the electrically conductive element 115. The substrates 102, 106, 120 and the insulating means 116, 126 are assembled substantially parallel to each other such that the second hole 118, the third hole 128, the electrically conductive first layer 104, and the electrically conductive second layer 122 are all positioned within the area defined by the first hole 108. The substrates 102, 106, 120 and the insulating means 116, 126 may be attached together with epoxy, solder, a clamping device, or via high temperature processing, such as in a co-fired ceramic procedure. The method in which the substrates 102, 106, 120 and the insulating means 116, 126 are attached is not critical provided the thickness of the attachment mechanism does not significantly degrade the functionality of the assembled motion sensing apparatus 200.

The geometric shape of the holes 108, 118, 128 is preferably circular; thus, the electrically conductive element 115 moves within a cylindrical cavity formed by the alignment of the three holes 108, 118, 128 and the interior surface 110 of the first hole 108. However, the holes 108, 118, 128 may be other geometric shapes depending on the desired sensitivity of the assembled motion sensing apparatus 200.

In a preferred embodiment, the electrically conductive strips 112 extend from one major surface of the second substrate 106 to its other major surface. However, the electrically conductive strips 112 need only extend partially from the second substrate's first major surface to its second major surface in order to ensure proper functionality of the present invention. That is, the electrically conductive strips 112 need only be long enough to enable the electrically conductive element 115 to simultaneously contact the electrically conductive strips 112 and either the electrically conductive first layer 104 or the electrically conductive second layer 122.

In a preferred embodiment, the assembled motion sensing apparatus 200 is very small, however the size of the assembled motion sensing apparatus 200 may vary according to prospective applications. The size of the assembled motion sensing apparatus 200 is defined by its thickness 201, width 203, and length (not shown). As in a preferred embodiment,—utilizing a 0.508 millimeter diameter electrically conductive spherical ball 115, and 0.254 millimeter thick alumina ceramic for all three substrates 102, 106, 120 and both insulating means 116, 126—the assembled motion sensing apparatus 200 has a thickness 201 of 1.27 millimeters, width 203 of 2.54 millimeters, and length of 2.54 millimeters. However, when using various other materials, the assembled motion sensing apparatus 200 may be fabricated as large, or as small, as current technology allows.

The assembled motion sensing apparatus 200 preferably detects motion in the following manner. Assume for the purposes of this discussion that the electrically conductive element 115 is initially at rest in the center of the cavity and is only in contact with the electrically conductive first layer 104. When the assembled motion sensing apparatus 200 accelerates in either the x-direction or the y-direction, the electrically conductive element 115 moves (i.e., accelerates or decelerates) until it encounters the interior surface 110 of the first hole 108. Upon encountering the interior surface 110, the electrically conductive element 115 contacts the electrically conductive strips 112, and inherently provides a low resistance path between the electrically conductive strips 112, and the electrically conductive first layer 104. Since the first substrate's feedthrough contact trace 105 is electrically coupled to the electrically conductive first layer 104, the low resistance is detected by measuring the resistance between the circuit 114 and the first substrate's feedthrough contact trace 105 with external resistance sensing circuitry (not shown). Upon disengaging the interior surface 110, the electrically conductive element 115 breaks contact with the electrically conductive strips 112 and a high resistance path is formed between the electrically conductive strips 112 and the electrically conductive first layer 104. This high resistance is also detected using the external resistance sensing circuitry. Thus, motion of the assembled motion sensing apparatus 200 is detected by monitoring fluctuations in resistivity between the circuit 114 and the first substrate's feedthrough contact trace 105.

Motion of the assembled motion sensing apparatus 200 in the z-direction (i.e. upward and downward) is detected when the electrically conductive element 115 transitions, or bounces, between the electrically conductive first and second layers 104, 122. A low resistance path is formed between the electrically conductive strips 112 and one of the electrically conductive layers 104, 122 when the electrically conductive element 115 simultaneously contacts the electrically conductive strips 112 and either electrically conductive layer 104, 122. The low resistance path is severed as the electrically conductive element 115 transitions between the electrically conductive layers 104, 122. Therefore, motion of the assembled motion sensing apparatus 200 is sensed by monitoring the fluctuations in resistivity between the circuit 114 and the first substrate's feedthrough contact trace 105, the circuit 114 and the third substrate's feedthrough contact trace 124, or both. Note that when the electrically conductive element 115 is initially at rest in the center of the cavity, pure z-direction movement will not result in contact between the electrically conductive strips 112 and either electrically conductive layer 104, 122. However, the probability of pure z-direction movement is remote; thus, the present invention accordingly detects motion in the z-direction with a high degree of probability. Since the assembled motion sensing apparatus 200 senses motion in all three dimensions, its orientation is inconsequential. In contrast, spatial orientation of prior art motion detectors is critical since they are limited to sensing motion in only one or two dimensions.

The present invention provides a motion sensing apparatus that can detect motion in three dimensions, that can withstand high acceleration and deceleration forces (e.g., greater than 10,000 G), and that is capable of maintaining a high level of sensitivity throughout it's operational life while proficiently sensing extremely low acceleration and deceleration forces (e.g., less than 0.01 G). With this invention, the inaptitude of single prior art motion detectors to detect motion in three dimensions is overcome. Multiple prior art devices are currently required to detect motion in more than two dimensions. Further, the present invention combines the beneficial characteristics of high detection sensitivity and structural ruggedness; whereas, prior art detectors provide only one of the two desired characteristics. Still further, the present invention is smaller than its prior art counterparts and does not utilize environmentally hazardous materials.

I claim:

1. A motion sensing apparatus, comprising;

a first substrate having an electrically conductive first layer disposed on a first major surface thereof;

a second substrate having a first major surface and a second major surface and further having a first hole that includes an interior surface extending from the first major surface of the second substrate to the second major surface of the second substrate, wherein the second major surface of the second substrate is positioned substantially parallel with the first major surface of the first substrate, and wherein the electrically conductive first layer is positioned substantially within an area defined by the first hole;

a third substrate having an electrically conductive second layer disposed on a first major surface thereof, wherein the electrically conductive second layer is positioned substantially within the area defined by the first hole, and wherein the first major surface of the third substrate is positioned substantially parallel with the first major surface of the second substrate;

contact means disposed substantially within a cavity defined, at least in part, by the interior surface, for providing a motion sensing signal; and at least one electrically conductive element positioned within the cavity, for providing contact between the contact means and either the electrically conductive first layer or the electrically conductive second layer.

2. The motion sensing apparatus of claim 1, wherein the contact means comprises a plurality of electrically conductive strips extending from the first major surface of the second substrate toward the second major surface of the second substrate.

3. The motion sensing apparatus of claim 2 further comprising:

insulating means, disposed between the electrically conductive second layer and the plurality of electrically conductive strips, for providing electrical isolation between the electrically conductive second layer and the plurality of electrically conductive strips.

4. The motion sensing apparatus of claim 3 further comprising:

a circuit disposed on the first major surface of the second substrate, wherein the circuit is electrically coupled to the plurality of electrically conductive strips.

5. The motion sensing apparatus of claim 1 further comprising:

a circuit disposed on the first major surface of the second substrate, wherein the circuit is electrically coupled to the contact means.

6. A motion sensing apparatus, comprising;

a first substrate having an electrically conductive first layer disposed on a first major surface thereof;

a second substrate having a first major surface and a second major surface and further having a first hole that includes an interior surface extending from the first major surface of the second substrate to the second major surface of the second substrate, wherein the second major surface of the second substrate is positioned substantially parallel with the first major surface of the first substrate, and wherein the electrically conductive first layer is positioned substantially within an area defined by the first hole;

a plurality of electrically conductive strips deposited on the interior surface, wherein the plurality of electrically conductive strips extend from the first major surface of the second substrate to the second major surface of the second substrate;

first insulating means, disposed between the electrically conductive first layer and the plurality of electrically conductive strips, for providing electrical isolation between the electrically conductive first layer and the plurality of electrically conductive strips;

a third substrate having an electrically conductive second layer disposed on a first major surface thereof, wherein the electrically conductive second layer is positioned substantially within the area defined by the first hole, and wherein the first major surface of the third substrate is positioned substantially parallel with the first major surface of the second substrate;

second insulating means, disposed between the electrically conductive second layer and the plurality of electrically conductive strips, for providing electrical isolation between the electrically conductive second layer and the plurality of electrically conductive strips; and at least one electrically conductive element positioned within the area defined by the first hole, for providing contact between the plurality of electrically conductive strips and either the electrically conductive first layer or the electrically conductive second layer.

7. The motion sensing apparatus of claim 6, wherein the first insulating means comprises a fourth substrate having a second hole disposed therethrough, and wherein the second insulating means comprises a fifth substrate having a third hole disposed therethrough, and wherein the second hole and the third hole are each positioned substantially within the area defined by the first hole.

8. The motion sensing apparatus of claim 6, wherein the at least one electrically conductive element comprises a spherical ball.

9. The motion sensing apparatus of claim 6 further comprising:

at least one circuit disposed on the first major surface of the second substrate, wherein the at least one circuit is electrically coupled to the plurality of electrically conductive strips.

* * * * *